US009907379B2

(12) United States Patent
Tyrer

(10) Patent No.: US 9,907,379 B2
(45) Date of Patent: Mar. 6, 2018

(54) CARRIABLE SPORTS BAG

(71) Applicant: Stephen E. Tyrer, Deer Park, NY (US)

(72) Inventor: Stephen E. Tyrer, Deer Park, NY (US)

( * ) Notice: Subject to any disclaimer, the term of this patent is extended or adjusted under 35 U.S.C. 154(b) by 0 days.

(21) Appl. No.: 15/190,627

(22) Filed: Jun. 23, 2016

(65) Prior Publication Data

US 2016/0374444 A1 Dec. 29, 2016

Related U.S. Application Data

(60) Provisional application No. 62/184,490, filed on Jun. 25, 2015.

(51) Int. Cl.

| | |
|---|---|
| ***A45C 13/40*** | (2006.01) |
| ***A45C 13/26*** | (2006.01) |
| ***A45C 5/00*** | (2006.01) |
| ***A45C 3/00*** | (2006.01) |
| ***A45C 13/28*** | (2006.01) |
| ***A45C 15/00*** | (2006.01) |

(52) U.S. Cl.

CPC ..... *A45C 13/40* (2013.01); *A45C 3/00* (2013.01); *A45C 5/00* (2013.01); *A45C 13/26* (2013.01); *A45C 13/28* (2013.01); *A45C 15/00* (2013.01); *A45C 2003/007* (2013.01)

(58) Field of Classification Search

CPC .... A45C 3/00; A45C 3/02; A45C 3/04; A45C 5/00; A45C 13/26; A45C 13/28; A45C 13/40; A45C 15/00; A45C 2003/007; B65D 85/20; A63B 71/00

USPC ..... 206/315.1, 315.9; 383/66; 190/109–113

See application file for complete search history.

(56) References Cited

U.S. PATENT DOCUMENTS

| | | | | |
|---|---|---|---|---|
| 1,577,298 | A * | 3/1926 | Roeller | B62B 9/26 383/24 |
| 2,703,426 | A * | 3/1955 | Barkl | A47L 13/502 383/66 |
| 4,752,008 | A * | 6/1988 | Pratt | A45C 3/00 190/109 |
| 5,160,001 | A * | 11/1992 | Marceau | A45C 3/02 190/111 |
| RE34,361 | E * | 8/1993 | Pratt | A45C 3/00 190/109 |
| 6,367,674 | B1 * | 4/2002 | Tabor | A45F 3/04 224/153 |
| 7,407,454 | B2 * | 8/2008 | Guy | A63B 71/0045 224/602 |
| 2006/0060484 | A1 * | 3/2006 | Greeley | A63B 71/0045 206/315.1 |

(Continued)

*Primary Examiner* — Bryon Gehman

(74) *Attorney, Agent, or Firm* — Hoffmann & Baron, LLP

(57) ABSTRACT

A sports bag includes a top portion having a pair of openings or a sleeve through which an athlete's stick or bat may be mounted. The stick or bat when mounted on the sports bag provides a handle for carrying the sports bag. Preferably, the sports bag is slung over the shoulder of the athlete. The sports bag may be in the form of an elongated triangular shape having a bottom which is substantially rectangular, the narrow portion of the sports bag being positioned on a top thereof. The front end includes a contour to fit around and over the shoulder of the athlete. The invention also includes a method of carrying sporting equipment using the sports bag and sliding a sport's stick through the openings or sleeve and using the stick as the handle to carry the sports bag.

18 Claims, 9 Drawing Sheets

(56) References Cited

U.S. PATENT DOCUMENTS

| | | | | |
|---|---|---|---|---|
| 2006/0207900 | A1* | 9/2006 | Lytle | A45C 7/0086<br>206/315.9 |
| 2008/0252029 | A1* | 10/2008 | Walcott | A63B 71/0045<br>206/315.1 |
| 2010/0078280 | A1* | 4/2010 | Mauro | A45C 5/14<br>190/111 |
| 2011/0073226 | A1* | 3/2011 | Cusa | A63B 71/0045<br>206/315.1 |

* cited by examiner

CARRIABLE SPORTS BAG

FIELD OF THE INVENTION

The invention relates to a sports bag for carrying sporting equipment such as helmets, gloves, elbow pads, shoulder pads, balls and other sports gear. The invention relates more specifically to a sports bag which is adapted to be mounted and carried on a lacrosse stick, field hockey stick, hockey stick or baseball bat.

BACKGROUND OF THE INVENTION

Typically, sports bags are carried using a pair of shoulder straps such as those provided on a backpack or a single shoulder strap. Some sports bags may also include a handle and wheels so that the bag may be rolled, rather than carried. However, athletes do not always store their sports gear in a bag for transport. For example, it is not uncommon for lacrosse players to thread their equipment onto the shaft of their stick and carry the stick over their shoulder. This technique makes it difficult to carry all the gear required to play a lacrosse game.

OBJECTS AND SUMMARY OF THE INVENTION

It is an object of the present invention to design a sports bag which can be mounted onto an athlete's stick or bat.

It is a further object of the invention to provide a sports bag mountable onto a stick or bat which can be carried over the shoulder, similar to the way in which lacrosse players carry equipment on their sticks without the use of a bag.

It is an object of the invention to provide a sports bag which is adaptable to be used with different sized and shaped sticks and bats.

It is another object of the invention to provide a sports bag which is ergonomically designed to comfortably rest against the shoulder of the carrier.

These and other objects are accomplished by providing a sports bag which is mountable onto a player's stick or bat. In one embodiment, the sports bag includes a pair of openings provided at opposite ends of the bag which are dimensioned to receive a stick, e.g., a round aperture for a lacrosse stick shaft or a rectangular aperture for a hockey stick. Alternatively, the top of the sports bag may include a sleeve adapted to receive the stick or bat. In a preferred embodiment, the sports bag has an elongated triangular shape to accommodate sports gear such as helmets, gloves and pads. The larger bottom helps to keep the equipment organized within the bag.

The sports bag of the present invention may also include interior and exterior pockets to hold smaller items, such as, e.g., a mouth guard, eye black, water bottles and cell phones. In one preferred embodiment, the sports bag includes air vents, and more preferably waterproof air vents. The sports bag also preferably includes an access opening to the interior of the bag. The access opening is covered by a resilient member which permits items to be pushed through the opening yet be maintained within the interior of the sports bag. For example, the resilient member may be formed from a single piece of rubber having cuts and/or slots to create a series of flexible portions which are adapted to flex inward when an item is being packed into the sports bag and flex outward when an item is being removed from the bag.

BRIEF DESCRIPTION OF THE DRAWINGS

The present invention and the advantages thereof will become understood by reference to the following detailed description when considered in connection with the accompanying drawings.

DETAILED DESCRIPTION

Figure 1:
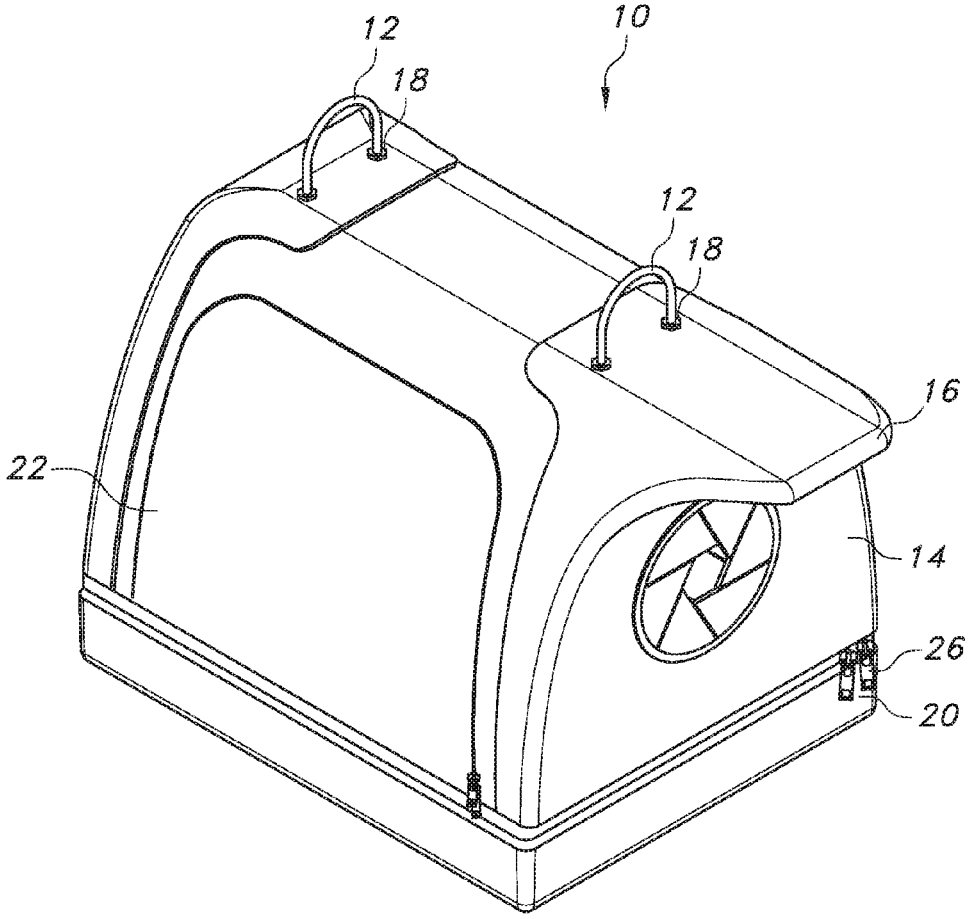
FIG. 1 is a front perspective view of the sports bag formed in accordance with the present invention.
Figure 2:
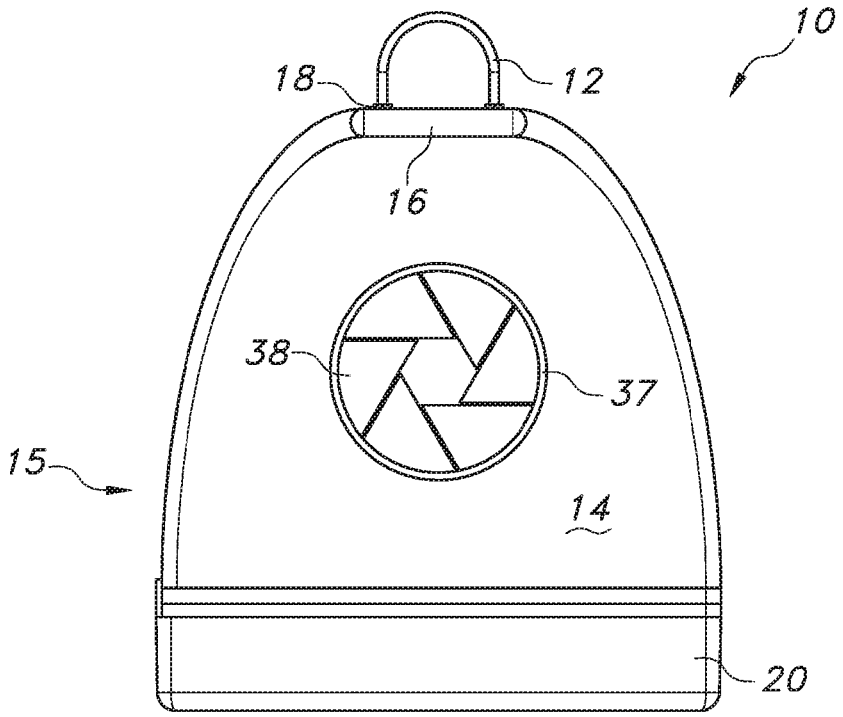
FIG. 2 is a front elevational view of the sports bag shown in FIG. 1.
Figure 3:
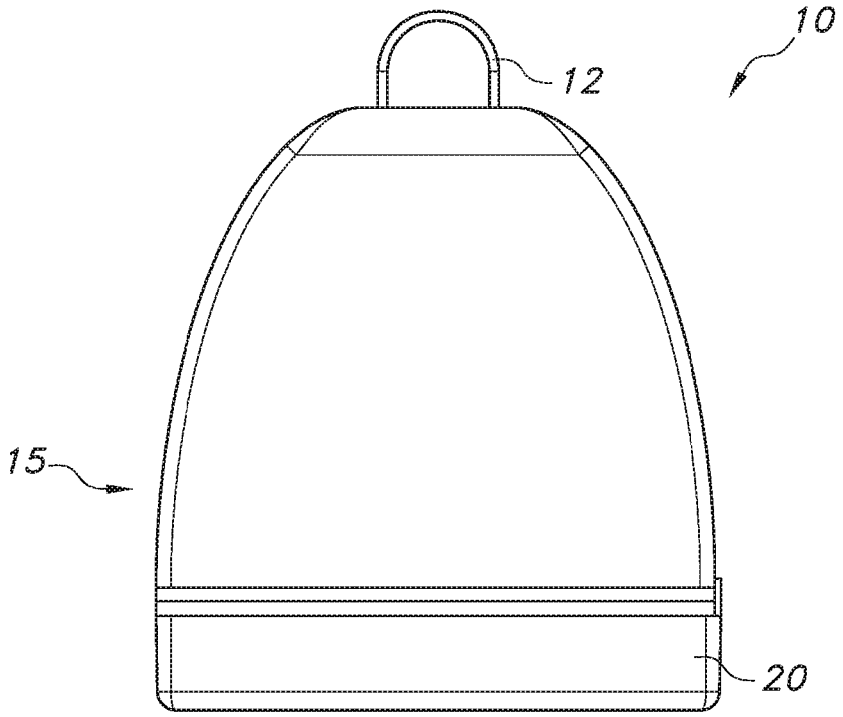
FIG. 3 is a rear side view of the sports bag shown in FIG. 1.
Figure 7:
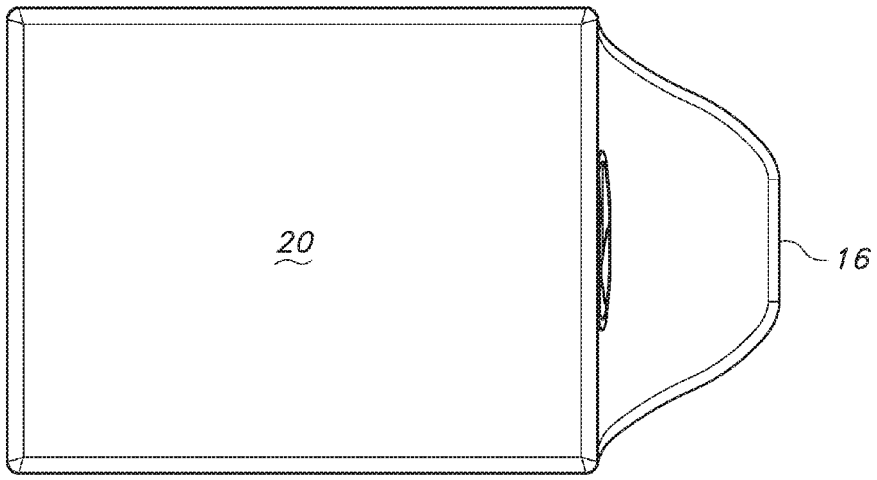
FIG. 7 is a bottom plan view of the sports bag shown in FIG. 1.
Figure 8:
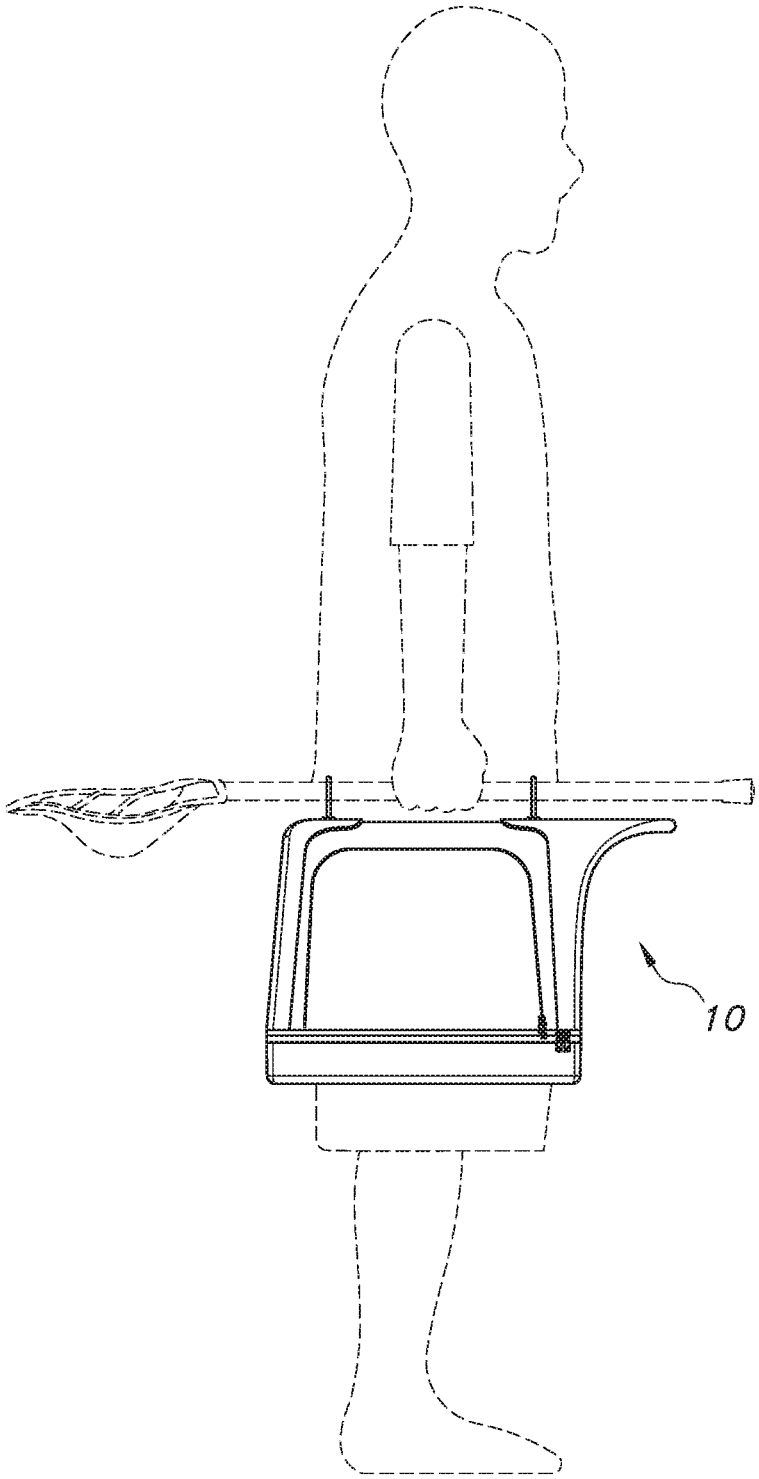
FIG. 8 is a side view of the sports bag of FIG. 1 mounted on a lacrosse stick and being carried like a briefcase.

As shown in FIGS. 1-12, the sports bag 10 of the present invention is mountable onto a player's stick or bat. As shown in FIG. 1, the sports bag includes a pair of spaced apart mounting rings 12 on a top surface of the bag. The mounting rings 12 include an opening designed to receive the shaft of a sports stick or bat such as, e.g., a lacrosse stick, hockey stick, field hockey stick or baseball bat. The sports bag 10 is preferably in the form of an elongated, rounded, triangular shaped body 15 as shown in FIGS. 2 and 3. The bottom as shown in FIG. 7, is substantially rectangular. One end of the sports bag 10 includes an ergonomically shaped contoured surface 14 to support the sports bag on the shoulder of the user.

Figure 4:
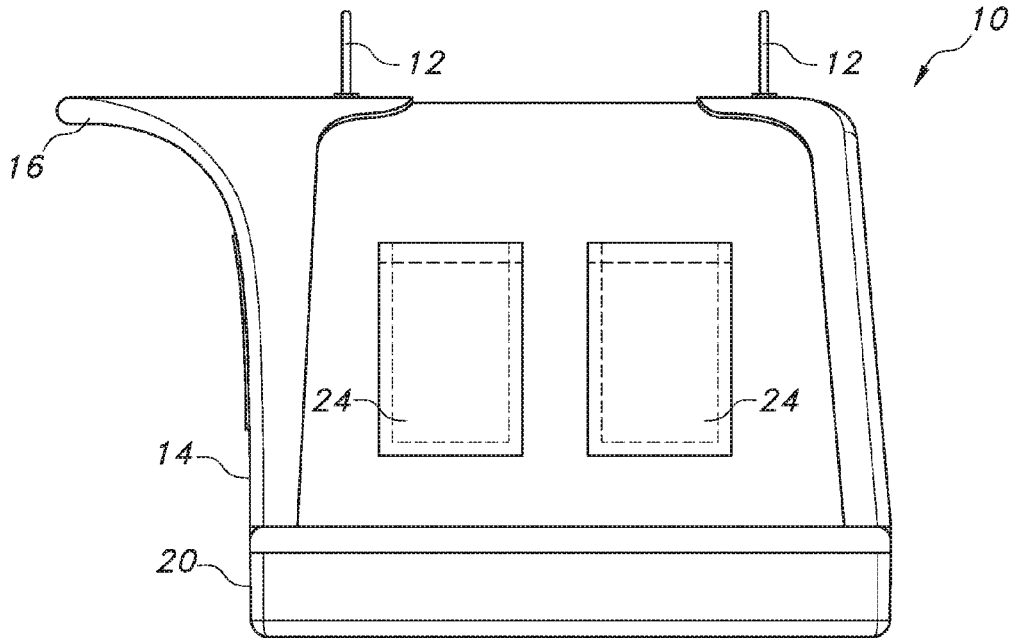
FIG. 4 is a right side view of the sports bag shown in FIG. 1.
Figure 5:
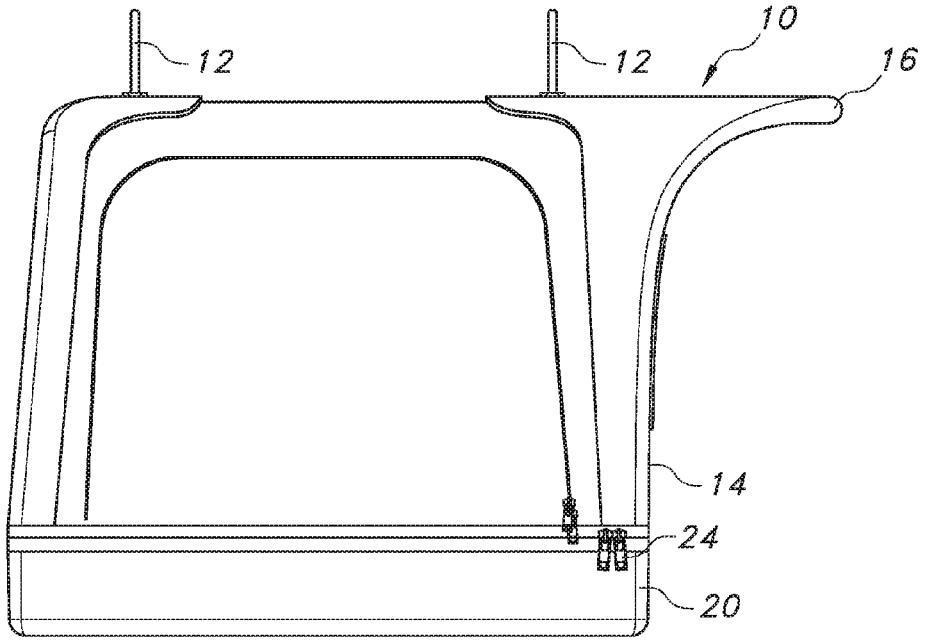
FIG. 5 is a left side view of the sports bag shown in FIG. 1.
Figure 6:
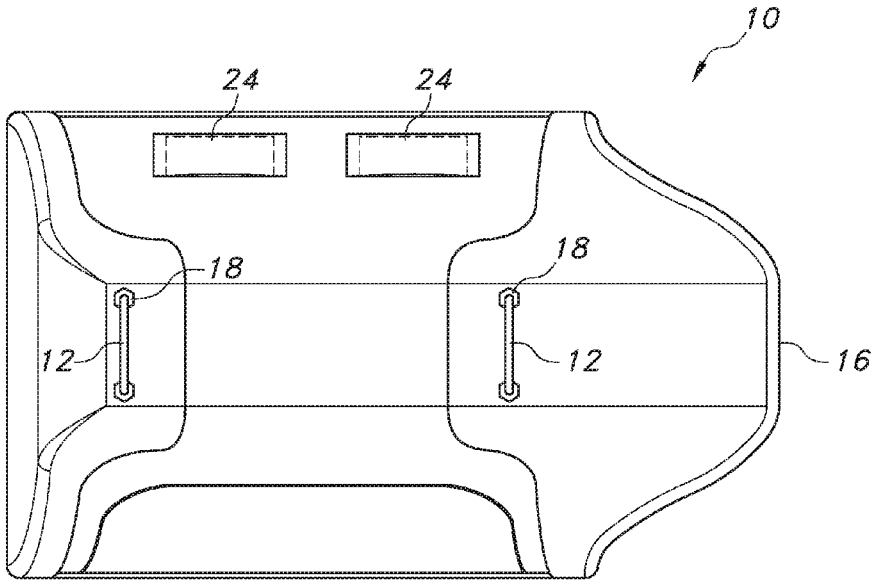
FIG. 6 is a top plan view of the sports bag shown in FIG. 1.
Figure 9:
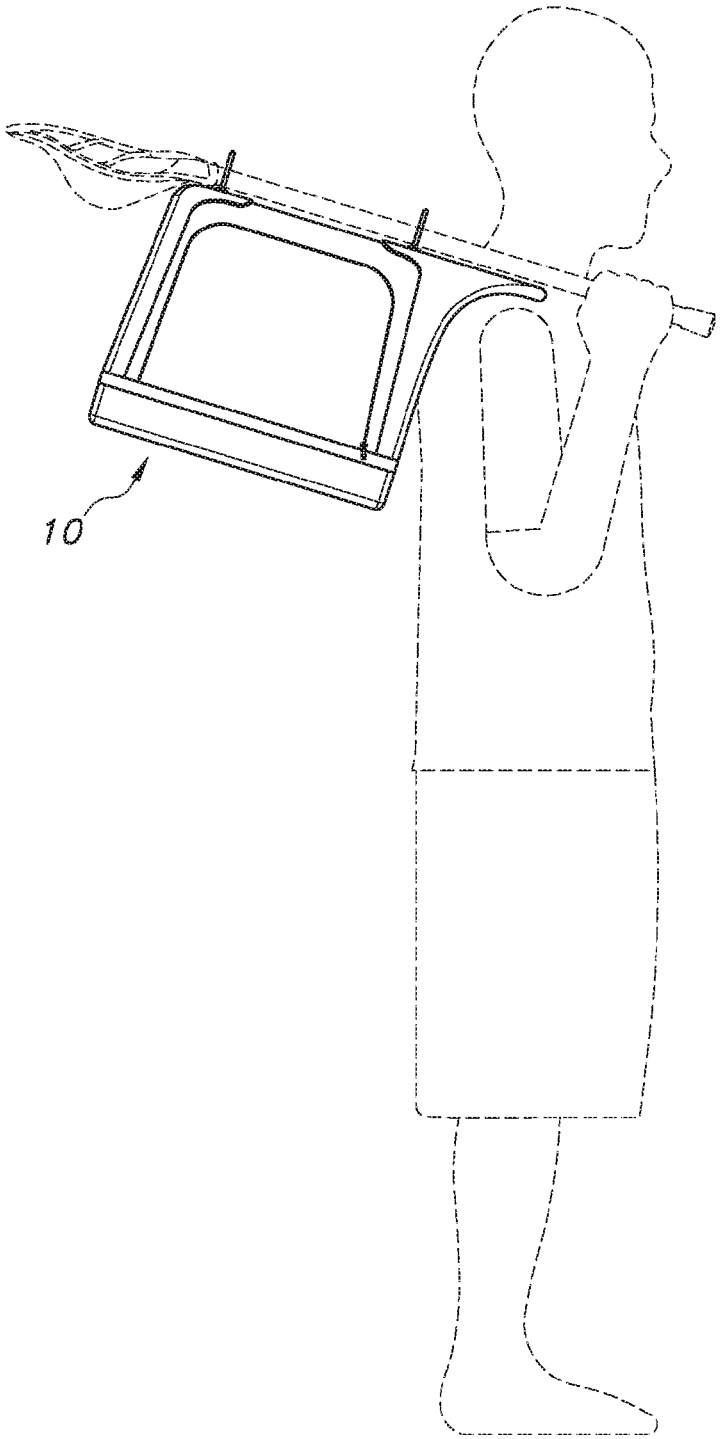
FIG. 9 is a side view of the sports bag of FIG. 1 mounted on a lacrosse stick and being carried over the shoulder.
Figure 12:
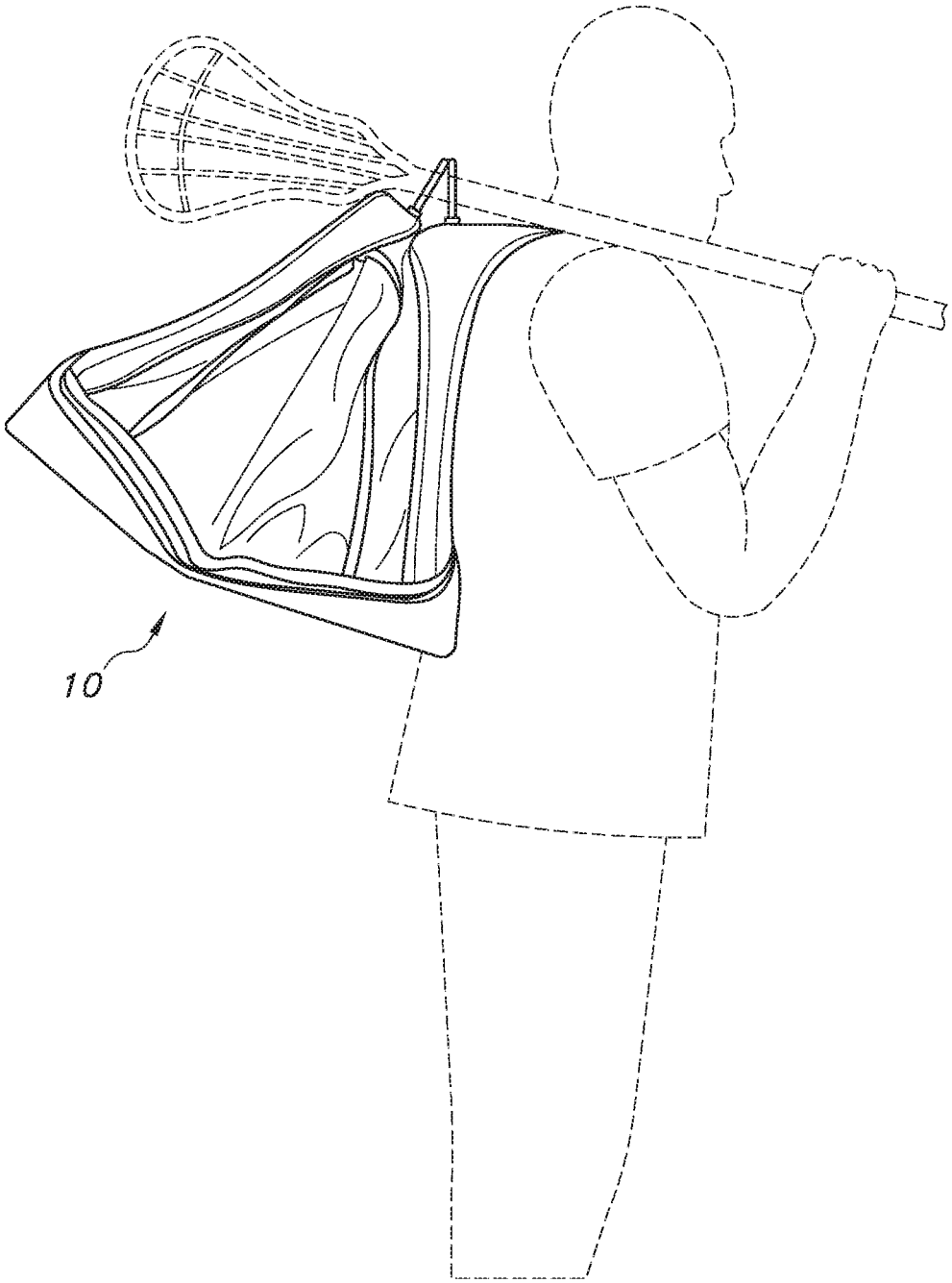
FIG. 12 illustrates the sports bag being carried over the shoulder wherein the top of the sports bag is collapsed onto itself.

More specifically, as shown in FIGS. 1, 4 and 5, the ergonomically shaped front end portion 14 includes a contour which allows a top portion 16 to extend over the shoulder of the user to protect the shoulder from the weight of the bag and stick. The extended top portion 16 also provides padding between the stick inserted in the sports bag mounting rings 12 and the user's shoulder. As shown in FIGS. 1, 2 and 5, the contoured end portion 14 is preferably concave and conforms to the shape of a user's back and shoulder as shown in FIGS. 9 and 12 to make carrying the sports bag 10 more comfortable.

The contoured front end portion 14 of the bag 10 is preferably made from a rigid or semi-rigid material which can hold the shape of the contour. Furthermore, padding may be provided along the contour in the areas which will contact the user's body to make carrying the sports bag full of equipment more comfortable. Alternatively, the contoured end portion 14 may be made from a flexible material which includes a semi-rigid padding material to substantially hold the shape of the contour.

With respect to the mounting rings 12, the aperture may be made any shape to accommodate different types of sticks. For example, the rings may be U-shaped or substantially curved for round-type sticks such as a lacrosse stick, field hockey stick or bat. Alternatively, the opening may be rectangular shaped to accommodate, for example, a hockey stick. As shown in FIGS. 1-5, the mounting rings may be removably attached to a top portion of the sports bag 10 by a pair of nuts 18. Thus, the mounting rings may be removed and replaced with different shaped rings depending upon the sports equipment to be carried. As shown in FIG. 1, the U-shaped mounting rings are dimensioned to accommodate both round sticks, such as lacrosse sticks, as well as rectangular sticks, such as hockey sticks. Furthermore, the mounting rings 12 may include a non-slip surface such as a rubber or vinyl coating so that a stick inserted into the rings will be retained in position when being carried in a non-parallel position to the user. Alternatively, the rings 12 may be fully formed from a non-slip material such as rubber.

In a preferred embodiment the bottom 20 of the sports bag 10 is made from a substantially rigid or hardened material to maintain the shape of the bag. A hard or semi-rigid bottom allows the equipment carried in the bag to be stacked. As shown in FIG. 7, the bottom 20 of the sports bag 10 is substantially rectangular while the overall shape of the bag as shown in FIGS. 1 and 3 is an elongated triangular shape 15. The triangular shape allows for larger objects, such as a helmet and shoulder pads to be placed at the larger bottom of the bag, while smaller items such as gloves and elbow pads may be stacked on top of the larger items in the narrower portion of the sports bag.

While the bottom 20 is preferably made from a rigid or semi-rigid material, the sides of the bag are preferably made from a flexible material such as, e.g., nylon, canvass or some other durable fabric. As shown in FIGS. 1 and 5, one side of the sports bag preferably includes a large zippered or otherwise releasably fastened flap 22 to gain access to interior of the sports bag. Furthermore, as shown in FIG. 4, the other side sports bag may include a plurality of pockets 24 for holding smaller items such as a mouthpiece, keys, water bottle, wallet and phone. As shown in FIGS. 1 and 5, a zipper 26 traverses three sides of the sports bag near the bottom to allow easy access to the entire interior of the sports bag 10.

Figure 10A:
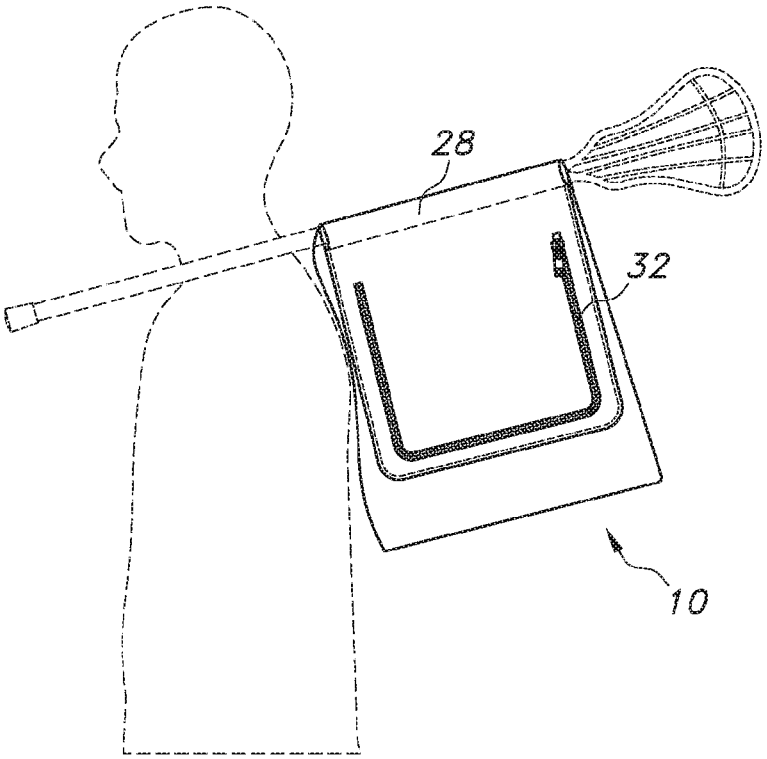
FIG. 10A an alternate embodiment of the sports bag formed in accordance with the invention using a sleeve adapted to receive the athlete's stick or bat.
Figure 10B:
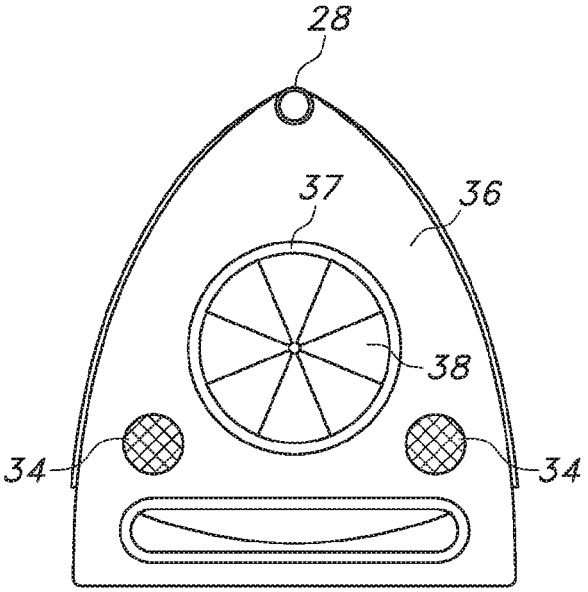
FIG. 10B is a front elevational view of the sports bag shown in FIG. 10A.

Referring to FIGS. 10A and 10B, an alternative embodiment of the sports bag 10 is illustrated. In FIG. 10A, the mounting rings have been replaced by an elongated sleeve 28 through which the stick extends to hold the sports bag. Furthermore, as shown in FIGS. 10A and 10B, the front portion 30 of the sports bag which contacts the back of the user is contoured to include a concave portion which is designed to follow the contour of the user's back. The exterior which extends over the shoulder of the user as shown in FIG. 1 has been eliminated in the embodiment shown in FIGS. 10B and 10B. As shown in FIG. 10A, the sports bag includes a large zippered flap 32 to allow access to the interior as well as additional pockets (not shown) for holding small articles.

The sports bag as shown in FIG. 10B also may include a lower zippered access to a bottom of the sports bag similar to that shown in FIG. 1. The back end 36 opposite the front side portion 30 which contacts a user's body preferably includes an access opening 37 to the interior of the bag which is covered by a resilient member 38 which permits items to be pushed through the opening 37 yet be maintained within the bag interior. This type of opening may also be provided on the sports bag as shown in FIG. 1 which illustrates an alternative style for the resilient member similar to a lens cap. For example, the resilient member 38 may be formed from a piece of rubber having cuts and/or slots therein to create a series of flexible portions which are adapted to flex inward when an item is being pushed into the sports bag and flex outward when an item is being removed from the bag. The aperture 37 closed by the resilient member 38 may be placed on any side of the sports bag 10. The sports bag may also include an insulated water bottle pocket, pocket for balls or pucks and/or a plurality of air vents 34 as shown in FIG. 10B.

Figure 11:
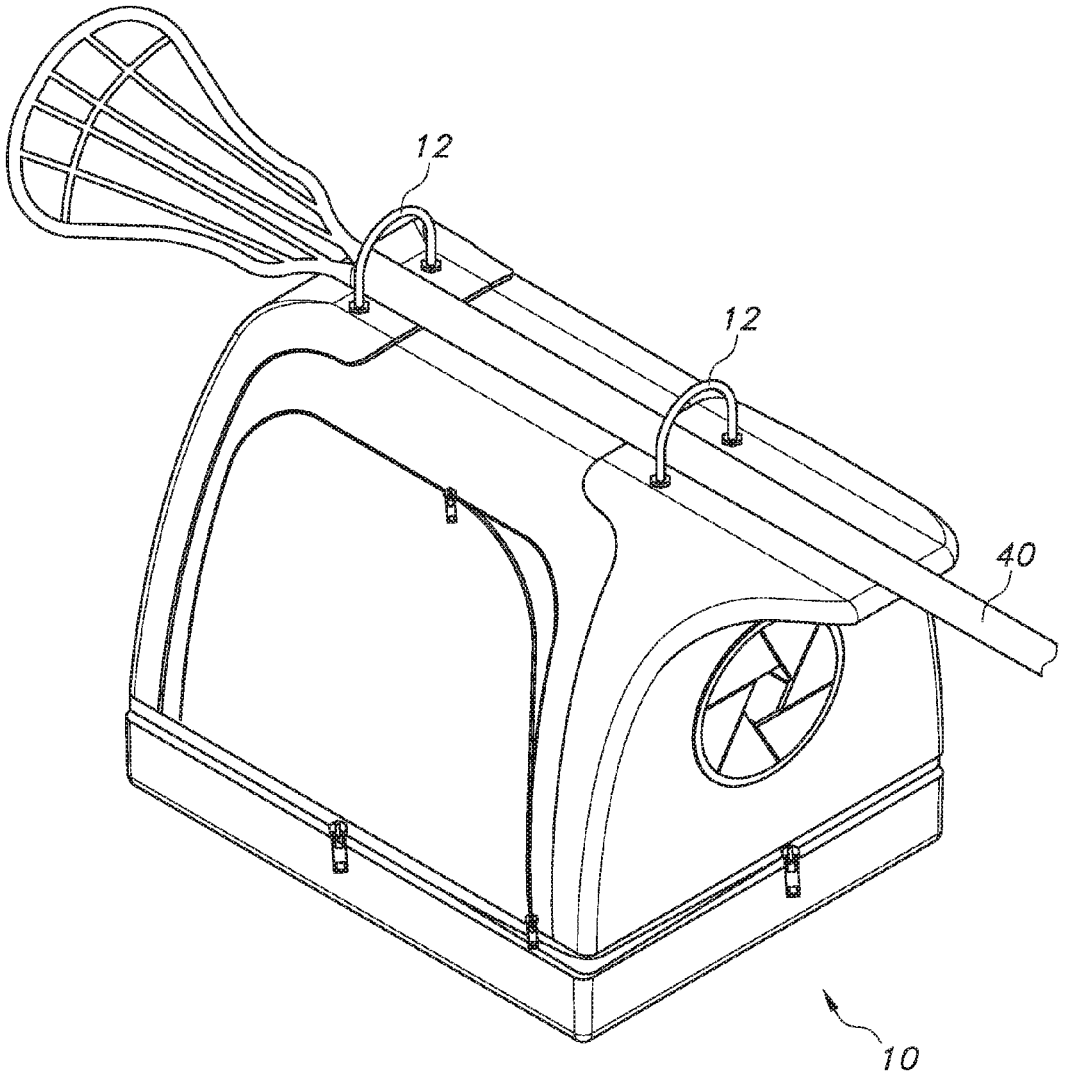
FIG. 11 is a front perspective view of the sports bag of FIG. 1 mounted on the shaft of a lacrosse stick.

FIG. 11 illustrates the sports bag 10 as shown and described with respect to FIGS. 1-9 having a lacrosse stick shaft 40 placed through the mounting rings 12. As shown in FIG. 11, the sports bag includes a contoured front end 14 and mounting rings 12 adapted to receive a shaft of a sports stick or baseball bat.

As discussed above, the means for mounting the sports bag on the stick may include removable and/or replaceable rings having apertures of different size and shape to accommodate different sticks. Thus, depending on the intended use, the replaceable rings 12 can be chosen to accommodate the specific type of stick on which the bag will be mounted.

FIG. 12 illustrates the sports bag 10 formed in accordance with the present invention mounted on the shaft of lacrosse stick and being carried on the shoulder of the user. As shown in FIG. 12, since the sports bag 10 sides are made of a flexible material, the top of the sports bag 10 may collapse so that the mounting rings 12 lie next to or adjacent each other. This collapsing of the top of the sports bag 10 allows more of the athlete's stick or bat to extend from the bag for ease of carrying on their shoulder as illustrated in FIG. 12.

While the present disclosure has been described with reference to one or more exemplary embodiments, it will be understood by those skilled in the art that various changes can be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the present disclosure.

What is claimed is:

1. A sports bag comprising:

a bag portion having an interior space adapted to hold sporting equipment, a top surface of the bag portion including means for mounting a sports stick or bat to the bag such that the sports stick or bat provides a handle for carrying the sports bag, and the sports bag including a concave contoured front end having an extension portion at a top thereof which extends over a user's shoulder when the bag is being carried on a sporting stick or bat slung over the shoulder of the user.

2. A sports bag as defined in claim 1, wherein the mounting means comprises a pair of spaced apart rings having apertures adapted to receive the sports stick or bat.

3. A sports bag as defined in claim 2, wherein the rings are substantially u-shaped.

4. A sports bag as defined in claim 1, wherein the mounting means comprises a sleeve having an opening adapted to receive the sports bag or bat.

5. A sports bag as defined in claim 1, wherein the contoured front end comprises a semi-rigid material which can hold its shape.

6. A sports bag as defined in claim 1, wherein the contoured front end includes padding.

7. A sports bag as defined in claim 1, wherein the sports bag comprises a substantially elongated triangular shape having a bottom which is substantially rectangular, the narrower portion of the sports bag being positioned at the top thereof.

8. A sports bag as defined in claim 1, wherein the mounting means is removable and replaceable with mounting means having different shaped openings adapted to receive the sports stick or bat.

9. A sports bag comprising;

a bag portion having an interior space adapted to hold sporting equipment, a top surface of the bag portion including means for mounting a sports stick or bat to the bag such that the sports stick or bat provides a handle for carrying the sports bag, and an aperture on a surface of the sports bag having a resilient member mounted therein, the resilient member allowing items to be pushed through the resilient member into the interior of the bag or pulled out of the interior of the bag through the resilient member, wherein the resilient member comprises a rubber member having cuts or slots therein which form a plurality of flexible portions which are adapted to flex inward when an item is being placed in the bag and then outward when an item is being removed from the bag.

10. A sports bag as defined in claim 9, wherein the plurality of flexible portions include overlapping portions.

11. A method of carrying sporting equipment comprising the steps of:

providing a sports bag having an interior space adapted to hold sporting equipment, a top surface of the sports bag including means for mounting a sports stick or bat to the sports bag, providing a sports stick or bat, sliding the sports stick or bat through the mounting means whereby a portion of the sports stick or bat extends outwardly from the sports bag;

placing the sports stick or bat over a user's shoulder so that the sport bag hangs from the sports stick or bat and rests against a back of the user, and wherein the sports bag further comprises a concave contoured front end having an extension portion at a top thereof which extends over a user's shoulder when the bag is being carried on a sporting stick or bat slung over the shoulder of the user.

12. The method of claim 11, wherein the mounting means comprises a pair of spaced apart rings having apertures adapted to receive the sports stick or bat.

13. The method of claim 11, wherein each of the rings is substantially u-shaped.

14. The method of claim 11, wherein the mounting means comprises a sleeve having an opening adapted to receive the sports stick or bat.

15. The method of claim 11, wherein the sports bag comprises a substantially elongated triangular shape having a bottom which is substantially rectangular, the narrower portion of the sports bag being positioned at the top thereof.

16. A sports bag comprising:

an elongated triangular shaped body portion having a substantially rectangular bottom portion wherein each side of the bottom is substantially longer than each end of the bottom, the body portion including means for accessing an interior space adapted to hold sporting equipment, and an enclosed top portion of the body portion including means for mounting a sports stick or bat to the sports bag, wherein a portion of the sports stick or bat extends outwardly beyond each end of the mounting means and wherein the sports stick or bat provides a handle for carrying the sports bag.

17. A sports bag as defined in claim 16, wherein the mounting means comprises a pair of spaced apart rings or a sleeve dimensioned to allow the sports stick or bat to slide therethrough.

18. A sports bag as defined in claim 16, wherein the elongated triangular shaped body portion is formed from a flexible material and the substantially rectangular bottom portion being formed of a semi-rigid material, and further wherein the body portion is collapsible.

* * * * *